US006860678B2

(12) United States Patent
Gunter

(10) Patent No.: US 6,860,678 B2
(45) Date of Patent: Mar. 1, 2005

(54) METHOD AND APPARATUS FOR ALIGNING CHANNEL SECTIONS WITH AN ADJUSTABLE ALIGNMENT KEY

(75) Inventor: Charles E. Gunter, Mooresville, NC (US)

(73) Assignee: ABT, Inc., Troutman, NC (US)

( * ) Notice: Subject to any disclaimer, the term of this patent is extended or adjusted under 35 U.S.C. 154(b) by 68 days.

(21) Appl. No.: 10/341,262

(22) Filed: Jan. 13, 2003

(65) Prior Publication Data

US 2004/0136785 A1 Jul. 15, 2004

(51) Int. Cl.[7] ..... E02B 5/00; E01F 5/00

(52) U.S. Cl. ..... 405/118; 405/122; 405/119; 405/121; 404/2; 404/3

(58) Field of Search ..... 405/118–123; 404/2, 3, 4

(56) References Cited

U.S. PATENT DOCUMENTS

| | | | | |
|---|---|---|---|---|
| 985,937 A | * | 3/1911 | Reynolds | 405/122 |
| 986,025 A | * | 3/1911 | Reynolds | 405/122 |
| 1,087,791 A | | 2/1914 | Leavitt | |
| 3,053,494 A | | 9/1962 | Stoll | |
| 3,611,731 A | * | 10/1971 | Edmondson | 405/120 |
| 4,498,807 A | | 2/1985 | Kirkpatrick et al. | |
| 4,787,773 A | * | 11/1988 | Kehler | 405/118 |
| 4,878,782 A | | 11/1989 | Beattie et al. | |
| 5,226,748 A | | 7/1993 | Bärenwald et al. | |
| 5,330,147 A | | 7/1994 | Volcheff et al. | |
| 5,372,457 A | * | 12/1994 | Rante | 405/119 |
| 5,522,675 A | | 6/1996 | Gunter | |
| 5,645,367 A | * | 7/1997 | Gunter | 404/3 |
| 5,702,204 A | | 12/1997 | Gunter | |
| 5,735,637 A | | 4/1998 | Gunter | |
| 6,012,691 A | | 1/2000 | van Leeuwen et al. | |
| 6,220,784 B1 | | 4/2001 | Bricker | |
| 6,494,641 B1 | | 12/2002 | Bracale et al. | |

FOREIGN PATENT DOCUMENTS

| | | |
|---|---|---|
| AU | B-76001/91 | 9/1991 |
| DE | 0S 25 06 705 | 8/1976 |
| JP | 57-178019 | 11/1982 |
| JP | 40407337 A | 3/1992 |
| WO | WO 79/00848 | 11/1979 |

* cited by examiner

*Primary Examiner*—Frederick L. Lagman
(74) *Attorney, Agent, or Firm*—Alston & Bird LLP

(57) ABSTRACT

A channel system for forming a trench is disclosed that includes a number of precast drainage channel sections and one or more alignment keys for aligning and interlocking adjacent channel sections. Each alignment key includes a base shaped for laterally bridging across a predetermined exterior portion of adjacent bottom walls of the adjacent channel sections. The alignment key also includes first and second opposed, inwardly facing jaw members shaped for longitudinally bridging across a predetermined exterior portion of adjacent first and second sidewalls, respectively, of the adjacent channel sections. Each pair of the jaw members can be carried by a respective base, and can be positioned in a lateral and longitudinal direction relative to the respective base to thereby substantially align and interlock the adjacent channel sections.

57 Claims, 8 Drawing Sheets

METHOD AND APPARATUS FOR ALIGNING CHANNEL SECTIONS WITH AN ADJUSTABLE ALIGNMENT KEY

FIELD OF THE INVENTION

The present invention generally relates to methods and apparatuses for forming trenches and, more particularly, relates to methods and apparatuses for forming trenches with precast channel sections.

BACKGROUND OF THE INVENTION

Drainage and other trenches of various sizes and shapes are desirable for numerous applications. For example, manufacturing facilities typically require drainage systems which include trenches formed in the building floors to collect, remove and/or recycle excess water or other liquids. In addition, numerous outdoor industrial and commercial sites, such as large parking lots, airports, roadways, toll plazas and the like require drainage systems, including trenches, to collect and direct rainwater and other liquids to underground storm sewers to prevent flooding and to decrease run-off. Similarly, trenches may be utilized for purposes other than drainage, such as to define a channel or duct through which electrical, optical or other cabling extends.

One method of forming these trenches has included placing and securing a number of precast channel sections in position, such as within a ditch which has previously been formed in the ground. A hardenable composition, such as cement, concrete or the like, is then poured around the channel sections and is allowed to set.

Once the hardenable composition has set, it is normally desirable to finish the trench with an elongate grate covering its open top in order to prevent people from unwittingly stepping in the open trench, to provide a smooth surface for vehicle travel, and/or to prevent relatively large objects from entering the trench and potentially blocking the flow of liquid therethrough in drainage applications or damaging cabling disposed within the trench in other applications. The grate is generally supported by a support surface defined longitudinally along an inner portion of each opposed sidewall of the channel sections. In order to stabilize the grate to prevent the grate from rocking when weight, such as from a passing vehicle, is applied thereto, the support surfaces defined by the opposed sidewalls of the channel sections must be aligned in a common plane during the pouring and setting of the hardenable composition about the channel sections. In addition, if the grate is not properly aligned, the grate and/or the channel itself can be damaged by the resulting movement of the grate. Furthermore, if the grate rocks excessively, the grate may even be dislodged from the channel to expose the trench defined thereby. Accordingly, the alignment of the channel sections in the moldable trench forming composition is important to the construction of a satisfactory trench.

Many drainage and other trenches are formed of a number of channel sections. It is also important to align the adjacent channel sections such that the sidewalls and bottom wall of the trench defined by the adjacent channel sections form continuous surfaces. For drainage applications, fluid will then flow smoothly therethrough and will not pool within the trench.

One common method of securing precast channel sections in an aligned relationship within a preformed ditch includes an anchor, such as that described in U.S. Pat. No. 4,498,807 which issued on Feb. 12, 1985 to Larry E. Kirkpatrick, et al.

(hereinafter the "'807 patent"). As illustrated in the '807 patent, an anchor generally includes a pair of downwardly extending, elongated spikes which are held in a parallel, spaced-apart relationship by a generally rectangular cross-piece. The anchor also includes a pair of upwardly extending arms that have a predefined shape which corresponds to and engages the predetermined exterior shape of lower portions of the precast channel sections. For example, each opposed sidewall of the precast channel sections can include an outwardly projecting rib extending longitudinally along lower portions of the channel sections. Correspondingly, upper portions of the arms of the anchor can include inwardly extending tabs which engage the longitudinally extending ribs and secure the anchor to lower portions of the channel sections. Accordingly, the anchor can be attached to a precast channel section and the elongated spikes can be inserted into the ground such that the channel section is held at a fixed position within the preformed ditch. Concrete can thereafter be poured about the channel sections to form the completed trench.

The anchors of the drainage channel system of the '807 patent therefore provide a means to accurately position or place each drainage channel section within the ditch. Although the '807 patent does not disclose a means for positioning adjacent drainage channel sections relative to one another, adjacent drainage channel sections can be aligned such that the side walls and bottom surfaces of the channel sections are contiguous. In one embodiment, the bottom surfaces of the drainage channel sections include a bottom surface which has a predetermined slope to facilitate drainage or fluid flow. According to this embodiment, the anchors of the drainage channel system of the '807 patent can position the individual drainage channel sections in an aligned relationship such that the presloped bottom surfaces are contiguous.

Another device for aligning adjacent drainage channel sections is described in U.S. Pat. No. 5,226,748 to Jörg R. Bärenwald et al., which issued on Jul. 13, 1993 and is assigned to ACO Polymer Products, Inc. (hereinafter the "'748 patent"). The '748 patent describes a clip-type support which engages, clamps and supports the end portions of adjacent drainage channel sections. The clip-type support includes two spaced-apart clip structures and an interconnecting central web. Each clip structure has a predetermined shape which corresponds to and mates with the predetermined exterior shape of the end portions of the adjacent drainage channel sections. In particular, each clip structure includes an elbow which receives and supports an outwardly projecting rib which extends longitudinally along the opposed sidewalls of the drainage channel sections. Thus, the adjacent drainage channel sections can be supported in an aligned relationship by the clip-type device. The center web of the clip-type support also includes a pair of outwardly extending tabs. In addition, the clip-type support includes a number of vertical support rods, each having a first end which extends through apertures defined in a respective outwardly extending tab. Each vertical support rod also includes a second end, opposite the first end, which can be imbedded in the ground to support the drainage channel sections in a predetermined spaced relationship above the bottom of the ditch.

In addition to being positioned in an aligned relationship, it is important that the adjacent channel sections be urged together and interlocked. For drainage applications, for example, this interlocking minimizes fluid leakage between adjacent drainage channel sections and escape from the trench. This is normally accomplished manually by careful checking of individual channel sections as they are placed on the individual supports. However, this is a time consuming process requiring substantial attention to detail, and it is easy to accidentally move a previously aligned channel section as a later channel section is being adjusted. In a like fashion, previously aligned channel sections can move or shift while the hardenable composition is poured about the channel sections.

BRIEF SUMMARY OF THE INVENTION

The present invention provides improved trench forming methods and apparatus. In one aspect, the invention provides an alignment key for aligning and longitudinally interlocking adjacent channel sections. In other aspects, the invention provides a channel system which allows a plurality of channel sections to be readily aligned and longitudinally interlocked within a preformed ditch.

In a first aspect, the invention provides an alignment key for aligning and longitudinally interlocking adjacent channel sections. Each longitudinally extending channel section has a predetermined exterior shape defined by a bottom wall and first and second sidewalls extending upwardly from opposite sides of the bottom wall. In accordance with this aspect, the alignment key includes a base shaped for laterally bridging across a predetermined exterior portion of adjacent bottom walls of the adjacent channel sections. In addition, the alignment key includes first and second opposed, inwardly facing jaw members shaped for longitudinally bridging across a predetermined exterior portion of adjacent first, and adjacent second sidewalls, respectively, of the adjacent channel sections. Each of the jaw members, which is capable of being carried by the base, is capable of being positioned in a lateral and a longitudinal direction with respect to the base to thereby substantially align and interlock the channel sections.

In one embodiment, each of the jaw members includes longitudinally opposed surfaces, or clamping members, positioned to engage the predetermined exterior portions of the respective sidewalls. In this embodiment, the exterior portion of the first and second sidewalls of the channel may include an exterior angled or beveled surface oriented in both a longitudinal and an laterally outward direction. The corresponding longitudinally opposed surfaces of the inwardly facing jaw members can then laterally inwardly converge along a longitudinal axis of the channel sections so as to engage the exterior angled surface of the channel sidewalls. Advantageously, the corresponding longitudinally opposed surfaces are inwardly converging in generally opposed longitudinal directions.

The base of the alignment key can also include a pair of support surfaces capable of carrying respective jaw members. In this regard, the jaw members can be positioned in a lateral and longitudinal direction relative to respective support surfaces. More particularly, each support surface may include at least one slot extending laterally on the support surface. Similarly, each jaw member may include at least one slot extending perpendicular relative to the slot(s) of a respective support surface when the jaw members are carried by the respective support surfaces. The alignment key of this embodiment may then further include securing members that extend through the respective slots defined by the jaws and the support surfaces. By defining the slots and including the securing members, the jaw members can be longitudinally positioned relative to respective support surfaces by moving the securing members within the slots defined by the support surfaces. Similarly, the jaw members can be laterally positioned relative to respective support surfaces by moving the jaw members such that the position of the securing members within slots defined by the jaw members changes.

In one embodiment, the base further includes a bottom surface disposed in a spaced apart relationship with respect to the support surfaces of the base. Advantageously, the bottom surface can define an opening therethrough so as to provide the bottom surface with increased structural rigidity, and to facilitate at least a portion of hardenable composition contacting the bottom surface of adjacent channel sections during installation, described below. Also, in this embodiment, each support surface may include a bore. Similarly, the bottom surface includes a pair of bores, each bore of the bottom surface being generally aligned relative to a bore of a respective support surface. In this regard, a plurality of support members can be received by the aligned bores of the support surfaces and bottom surface. In one embodiment, the support members are legs of a generally U-shaped member.

The alignment key can also laterally and vertically align the adjacent channel sections. In particular, each jaw member advantageously includes a surface positioned to engage the predetermined exterior portions of the respective sidewalls to maintain the adjacent channel sections in a laterally aligned relationship. Further, each jaw member includes a surface positioned to engage the predetermined exterior portions of the respective sidewalls to align the adjacent channel sections in a predetermined vertical relationship.

Each jaw member can also include corresponding vertically extending surfaces positioned to engage predetermined exterior portions of the respective sidewalls. The vertically extending surfaces can be laterally inwardly converging along a generally vertical direction. In one embodiment of the present invention, the jaws are configured for use with channel sections which each have an outwardly extending lip of a predetermined width proximate the opposed ends thereof. Each jaw member can therefore include a recessed central portion defined between the opposed longitudinal surfaces that has a predetermined longitudinal width adapted to receive lips of the adjacent channel sections.

According to a method of one embodiment of the present invention, a plurality of channel sections are aligned, preferably both vertically and laterally, and are longitudinally interlocked by one or more alignment keys. The aligned channel sections are then anchored upon a support surface, such as within a preformed ditch, and a hardenable composition is poured thereabout to form the completed channel as it sets. Advantageously the alignment of the adjacent channel sections, is accomplished by positioning the opposed jaw members into contact with the respective sidewalls of the channel sections by positioning the jaw members in a lateral and a longitudinal direction relative to the base. The support members can then be positioned vertically relative to the base and thereafter secured to the base. Once the support members have been secured to the base, the aligned channel sections are preferably anchored by forming a subslab around lower portions of the support members at a location spaced below the bottom surface of the channel sections. In embodiments where the bottom surface of the base defines an opening, the hardenable composition is poured such that at least a portion of the hardenable composition fills the opening to advantageously facilitate contact of the hardenable composition with the bottom surface of the channel sections. Consequently, an aligned, longitudinally interlocked trench comprised of a plurality of contiguous channel sections can be readily formed according to the method and using the apparatus of embodiments of the present invention.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
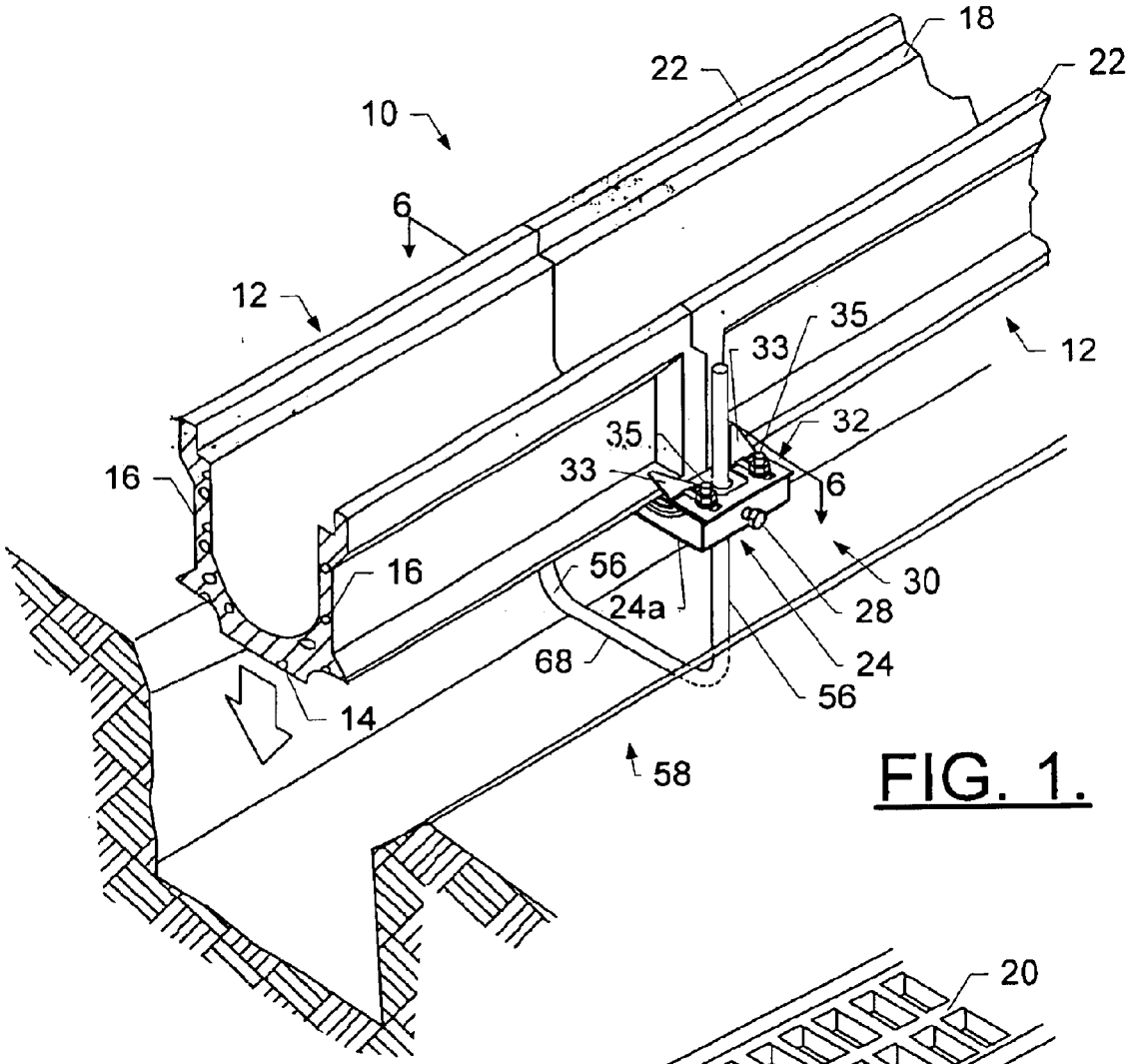
FIG. 1 is a perspective view of one embodiment of a channel system according to the present invention illustrating its placement in a preformed ditch.

Referring to FIG. 1, a channel system 10 according to one embodiment of the present invention is illustrated during placement in a preformed ditch. The channel system may be employed in a wide variety of applications. For example, the channel system may define a drainage trench for collecting and directing various liquids, such as water, chemicals or the like. Alternatively, the channel system may define a duct through which cables or other conduits extend. Moreover, while the channel system is depicted to be disposed within a ditch, the channel system may be disposed upon other surfaces with a hardenable composition then poured thereabout as described in conjunction with the illustrated embodiment.

As shown, the channel system 10 includes a plurality of longitudinally extending preformed or precast channel sections 12. The channel sections can be precast from various cementitious materials depending upon the application, such as the type of fluid which the trench is to collect and/or the type of loads which the trench is designed to support. For example, precast channel sections are typically formed of polyester concrete, a concrete aggregate material containing coarse and inert mineral fillers bonded with polyester resin. As will be apparent, the channel sections can be cast from other cementitious and/or thermoformable or thermosetting polymers or formed from cast or formed metals such as stainless steel sheet.

Figure 2:
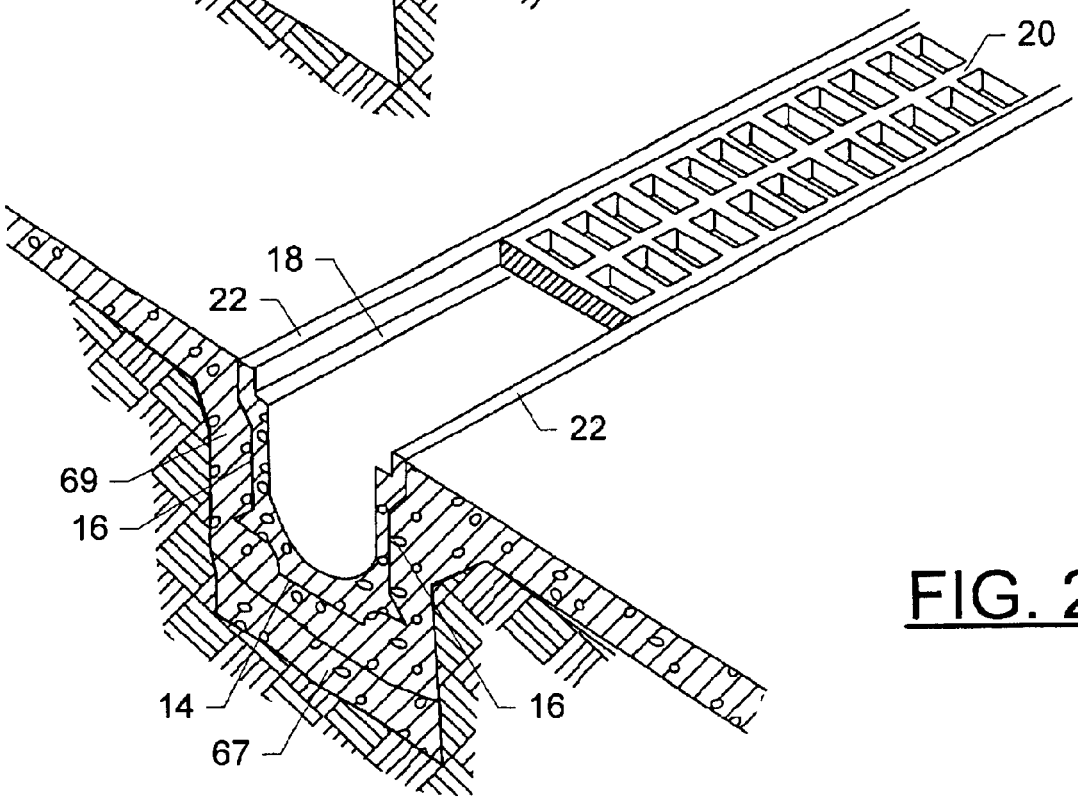
FIG. 2 is a perspective view of the channel system of FIG. 1 following placement thereof in a preformed ditch and pouring of hardenable composition about the channel sections.
Figure 3A:
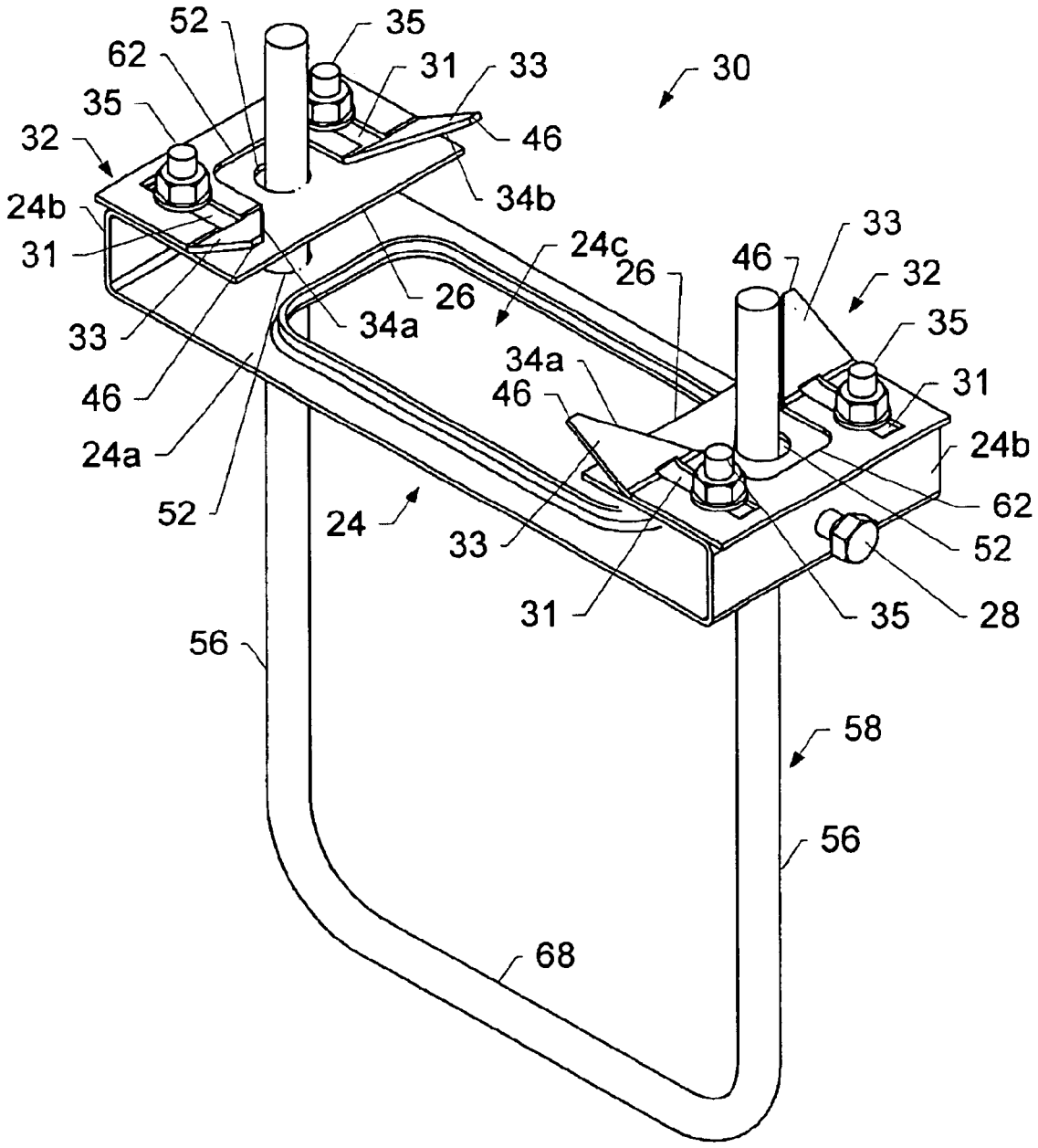
FIGS. 3A–3D are exploded perspective, top, side and front views, respectively, of an alignment key according to one embodiment of the present invention.
Figure 3B:
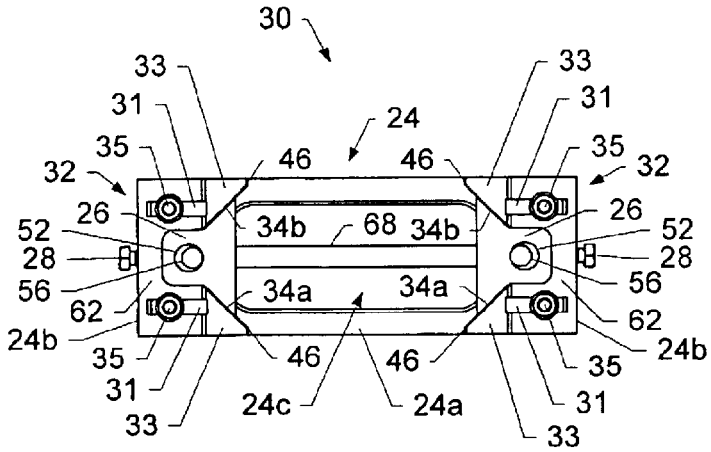
Figure 3C:
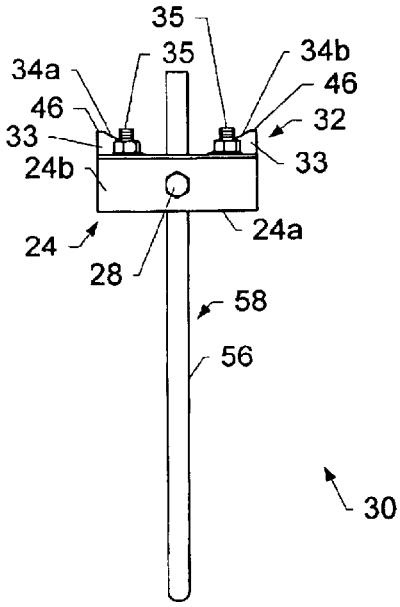
Figure 3D:
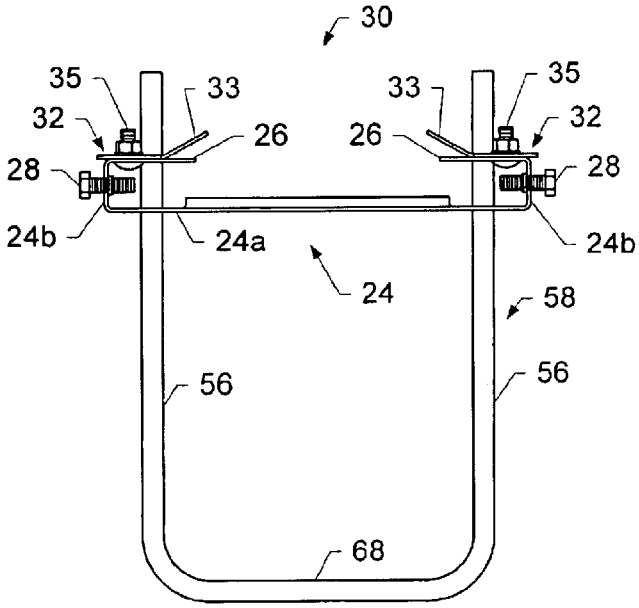
Figure 4A:
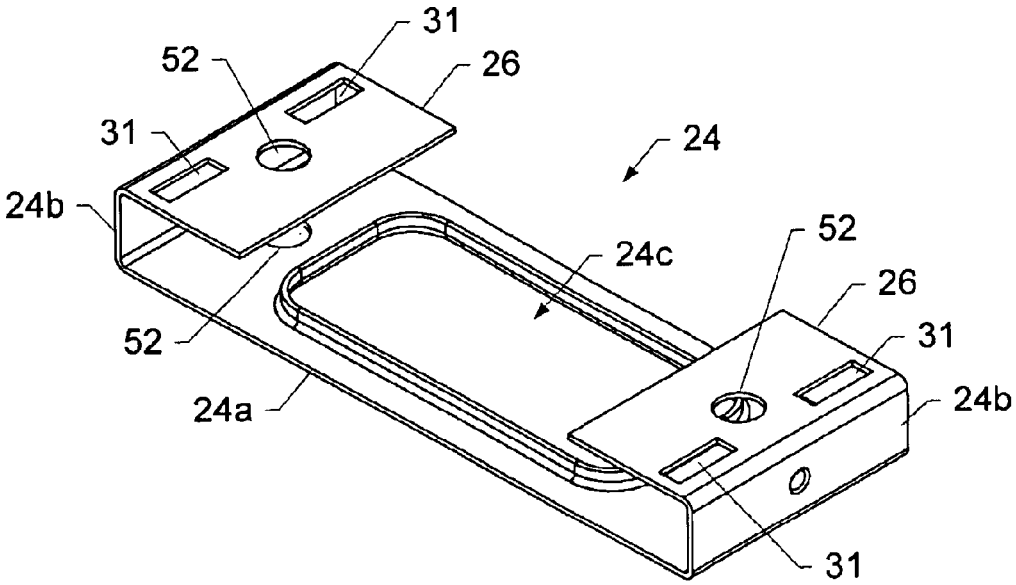
FIGS. 4A–4D are exploded perspective, top, front and bottom views, respectively, of a base of the alignment key of FIGS. 3A–3D, according to one embodiment of the present invention.
Figure 4B:
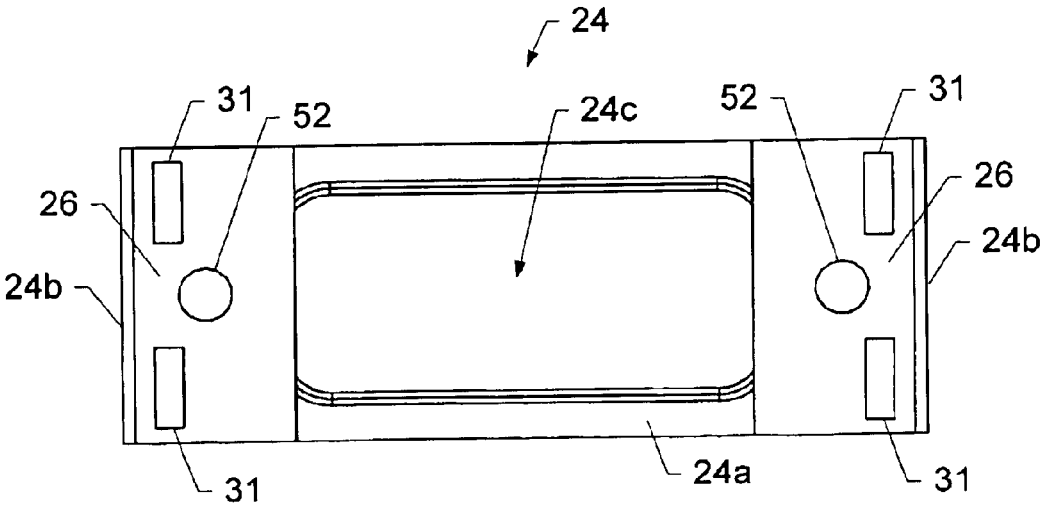
Figure 4C:
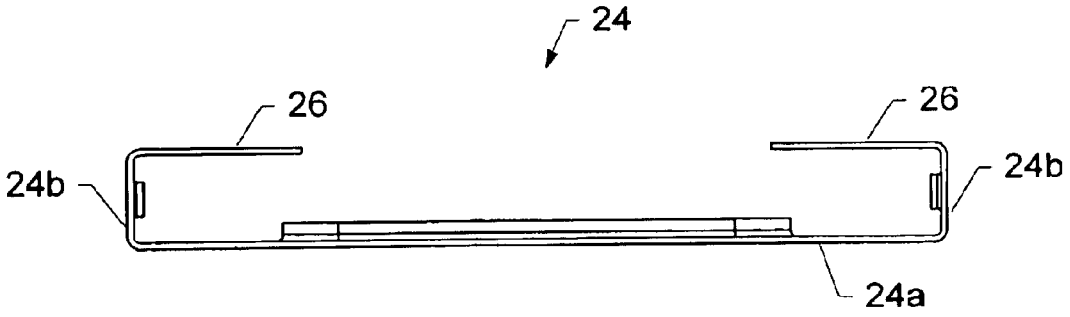
Figure 4D:
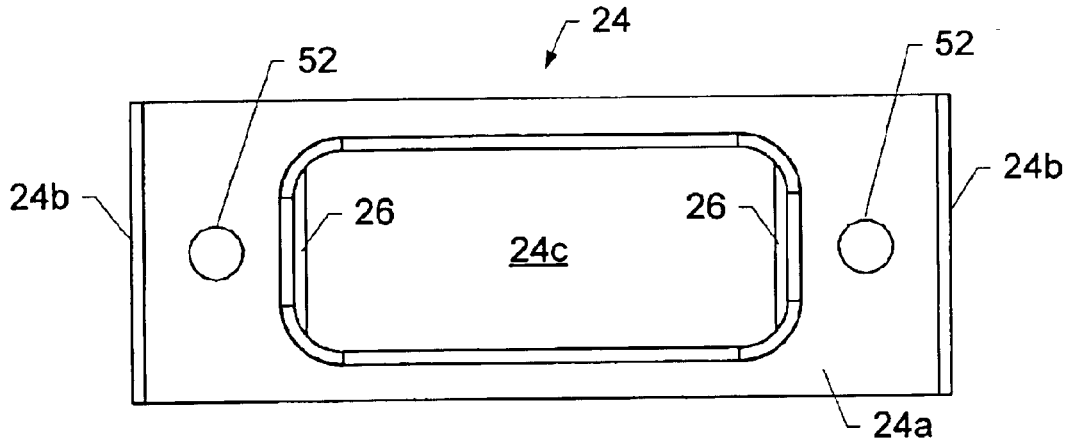
Figure 5A:
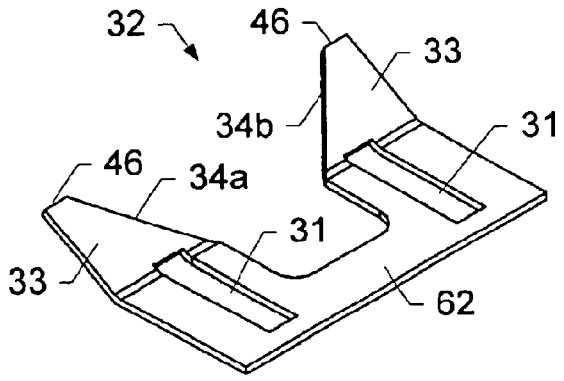
FIGS. 5A–5D are exploded perspective, top, back and side views, respectively, of one of the jaw members of the alignment key of FIGS. 3A–3D, according to one embodiment of the present invention.
Figure 5B:
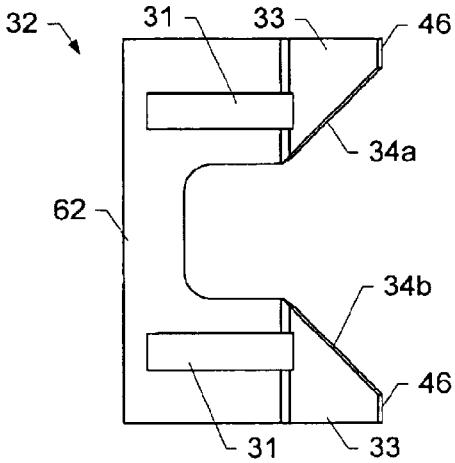
Figure 5C:
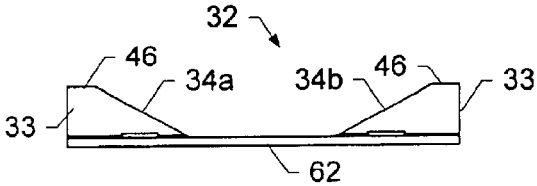
Figure 5D:
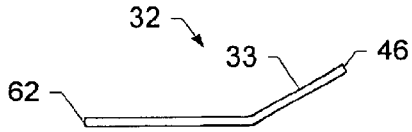

Each channel section 12 has a predetermined exterior shape defined by a bottom wall 14 and first and second sidewalls 16 extending upwardly from opposite sides of the bottom wall. Upper portions of the opposed first and second sidewalls each include a longitudinally extending support surface 18. Each support surface preferably extends substantially horizontally and is adapted to receive and support a grate 20 which covers the open top of the channel as shown in FIG. 2. The bottom wall and first and second sidewalls can define any of a number of different cross-sections, including a U-shaped cross-section as in the illustrated embodiment.

Each opposed sidewall 16 also preferably includes a longitudinally extending upper edge portion 22 extending upwardly along an outer portion of each support surface 18. As shown, the vertical distance from the upper edge portion 22 to the support surface 18 is preferably substantially equal to the thickness of the grate 20 such that the grate is aligned with upper portions of the sidewalls to provide a smooth surface, e.g., for vehicle travel. The support surface and the adjacent upwardly extending edge portion of the opposed sidewalls of the channel section 12 are preferably sized to receive the grate and to stabilize the grate by preventing excessive lateral movement of the grate and by preventing the grate from rocking when weight is applied thereto.

The channel system 10 of the present invention also includes an alignment key 30 for aligning and interlocking adjacent channel sections 12 as shown in FIG. 1. While the alignment key can be formed of various materials, the alignment key of one embodiment is formed of steel, such as 12, 14 or 16 gauge low carbon steel. As illustrated in more detail in FIGS. 3–5, the alignment key includes first and second opposed, inwardly facing jaw members 32, which are carried by a base 24. In this regard, the base includes first and second support surfaces 26 that carry respective jaw members and that are disposed on opposite sides of the channel sections. The base may be configured in various manners. In the illustrated embodiment, for example, the base includes a bottom surface 24*a* that extends transversely below the channel sections, and first and second opposed, inwardly extending support surfaces. The support surfaces are spaced from the bottom surface, such as by means of side portions 24*b* extending upwardly from opposite sides of the bottom surface.

The bottom surface 24*a* of the base 24 is of sufficient transverse length, and is shaped for longitudinally bridging between predetermined exterior portions of the bottom wall 14 of the adjacent channel sections 12. More specifically, the bottom surface is of sufficient transverse length such that the jaw members 32 carried by the support surfaces 26 can bridge across predetermined exterior portions of the first and second sidewalls 16, respectively, of adjacent channel sections. In this regard, the first jaw member is shaped for longitudinally bridging across predetermined exterior portions of the respective first sidewalls of the adjacent channel sections. Likewise, the second jaw member is shaped for longitudinally bridging across predetermined exterior portions of the respective second sidewalls of the adjacent channel sections.

The base 24 may be configured in a number of different manners, however, without departing from the spirit and scope of the present invention. For example, the base maybe a planar structure, much like the bottom surface 24*a* of the illustrated embodiment, although opposite end portions of the planar structure serve as the support surfaces 26 for carrying respective jaw members 32. As another example, the support surfaces may be spaced apart from the bottom surface, such as by side portions 24*b*, and may extend outwardly therefrom for supporting respective jaw members.

As best illustrated in FIGS. 3 and 5, each of the jaw members 32 includes two clamping tabs or members 33 which include longitudinally opposed clamping surfaces 34*a* and 34*b*, shaped to engage the exterior portion of a sidewall 16 and to urge the adjacent channel sections 12 into an aligned, longitudinally engaged relationship. The longitudinally opposed surfaces 34*a* and 34*b* are designed to match the exterior portions of the sidewall with which they will mate and, in the illustrated embodiment, are diagonally oriented with respect to the longitudinal axis of the channel sections 12 and are thus opposed with respect to both the longitudinal and lateral axes of the channel section. As discussed in greater detail below, the longitudinally opposed surfaces 34*a* and 34*b* apply a longitudinally compressive force to the adjacent channel sections as the jaw member is moved in the laterally inward direction towards the center longitudinal axis of the channel sections to thereby substantially align and interlock the channel sections. Consequently, the resulting trench defined by the channel sections has aligned side and bottom walls and a relatively tight seal can be obtained between adjacent channel sections.

Each jaw member 32 is adapted to be removably secured to a respective support surface 26 of the base 24. In this regard, the jaw members are capable of being movably secured such that the jaw members can be positioned laterally and/or longitudinally with respect to respective support surfaces. As such, the jaw members may be positioned with respect to the end portions of the channel sections so as to bridge therebetween, and thereafter locked into place to secure the alignment key 10 to the channel sections, and to interlock adjacent channel sections together.

In one particular embodiment, shown best in FIGS. 4 and 5, each support surface 26 includes at least one and, in the illustrated embodiment, a pair of slots 31 separated from one another and extending laterally on opposing sides of the respective support surface. Similarly, in the illustrated embodiment, each jaw member 32 includes at least one and, in the illustrated embodiment, a pair of slots 31, which are separated from one another and extend perpendicular relative to the slot(s) 31 of a respective support surface when the jaw members are positioned upon and carried by the respective support surfaces. By including the slots 31 in the jaw members and support surfaces, securing members, such as bolts 35, may be extended through the slots 31 defined by the jaws and corresponding slots 31 defined by the support surfaces 26. Thereafter, by moving the jaw members relative to the respective support surfaces while the securing members are loosely disposed within the slots 31, the jaw members are capable of being positioned both longitudinally and laterally relative to respective support surfaces, as described below with respect to FIG. 9. While the slots defined by the support surfaces and the jaw members extend longitudinally and laterally, respectively, the slots defined by the support surfaces and the jaw members may be oriented differently while maintaining a perpendicular relationship, such as the slots defined by the support surfaces and the jaw members extending laterally and longitudinally, respectively.

Figure 6:
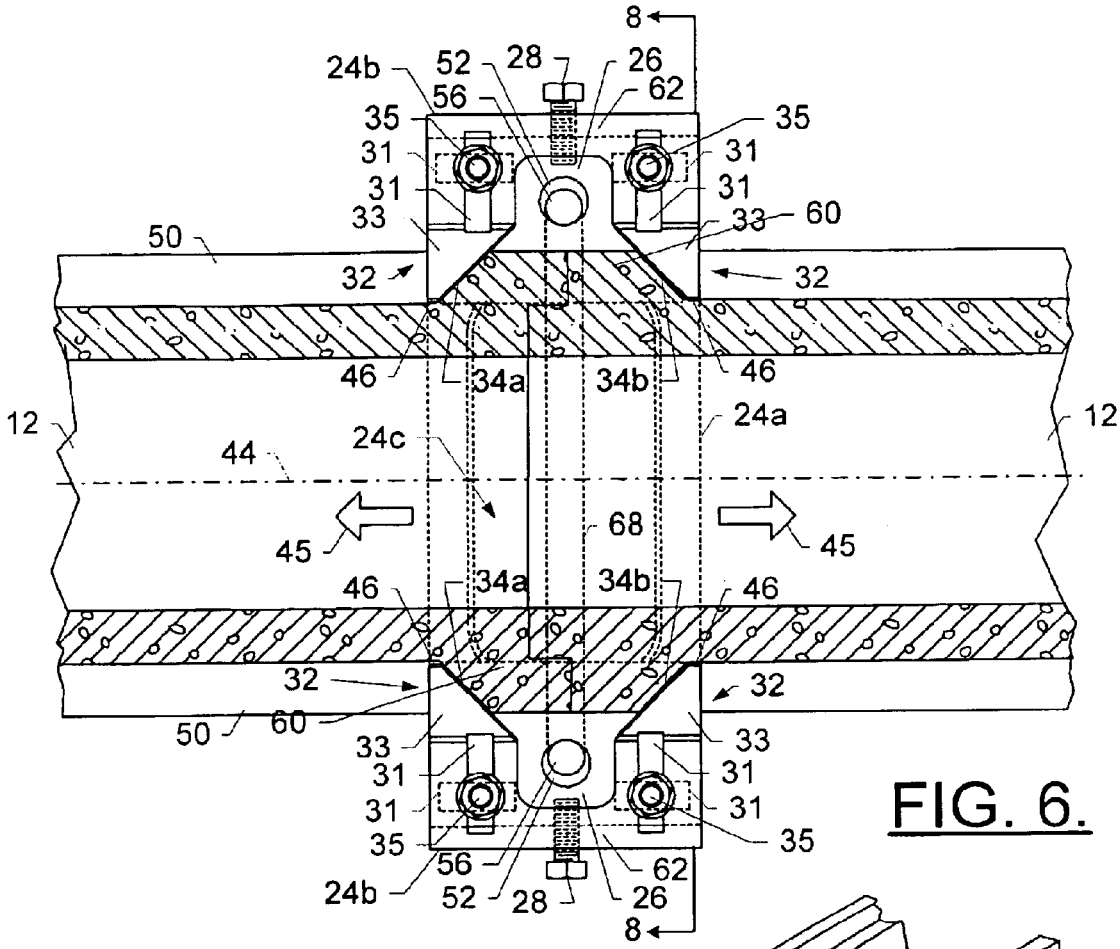
FIG. 6 is a top cross-sectional view of the channel system of FIG. 1 taken along line 6—6 of FIG. 1.

As shown in FIG. 6, the pairs of corresponding longitudinally opposed surfaces 34*a* and 34*b* of the jaw members 32 of one advantageous embodiment are inwardly converging with respect to a longitudinal axis 44 defined by the aligned channel sections 12. In other words, the corresponding longitudinally opposed surfaces of the first and second jaw members 34*a* and 34*b* are each diagonally oriented with respect to longitudinal axis 44 and are converging with respect to each other. As seen in FIG. 4, the corresponding longitudinally opposed surfaces of the jaw members are inwardly converging in generally opposing longitudinal directions outwardly from the joint between channel sections, as illustrated by the opposed arrows 45 in FIG. 6.

As best seen in FIGS. 1 and 5, the opposed jaw members 32 may, but need not necessarily, include corresponding vertically extending surfaces positioned to engage predetermined exterior portions of the respective sidewalls 16 of the adjacent channel sections 12 in order to align the sidewalls of the channel sections along substantially the same general vertical axes. In the illustrated embodiment, the longitudinally opposed surfaces 34*a* and 34*b* of the jaw members extend in the vertical direction as well as in the longitudinal direction and thus accomplish this vertical alignment as well as compressing the channel sections longitudinally together. In the embodiment shown in the drawings, the corresponding vertically extending surfaces of the jaw members are also inwardly converging along a generally vertical direction. However, the vertically extending surfaces can be oriented differently if desirable, for example, due to a different sidewall orientation in a particular channel configuration, and/or the opposed jaw members can include a distinct vertically extending surface, separate from the longitudinally opposed surfaces, to accomplish vertical alignment of the sidewalls of the channels.

In addition to longitudinally interlocking the adjacent channel sections 12, the alignment key 30 of the present invention also preferably laterally aligns the adjacent channel sections and vertically position the channel sections at predetermined heights. In particular, as best illustrated in FIG. 5, each jaw member 32 advantageously includes a lateral surface 46 positioned to engage predetermined exterior portions of the respective sidewalls 16 to laterally align the adjacent drainage sections. Each tab 33 on the jaws 32 which provides the longitudinally opposed surfaces 34*a* and 34*b* can preferably include a lateral alignment surface 46 which engages each respective sidewall laterally along a portion thereof to laterally align the adjacent channel sections. Thus, upon application of a laterally inwardly directed force to each jaw member 32, the lateral alignment surfaces 46 of the opposed jaw members exert a lateral alignment force on the opposed sidewalls of the abutting channel sections to laterally align the channel sections.

Advantageously, as best illustrated in FIGS. 3 and 5, the support surfaces 26 of the base 24 are adapted to engage predetermined exterior portions of the respective sidewalls 16 to align the adjacent channel sections 12 at a predetermined relative vertical height. The support surfaces 26 are positioned to engage a generally downwardly directed horizontal surface of longitudinally extending outwardly projecting ribs 50 defined along lower portions of the opposed sidewalls of the channel sections. Accordingly, the generally horizontally extending support surfaces 26 engage and support lower portions of the longitudinally extending ribs to align the adjacent channel sections in a predetermined vertical relationship.

As illustrated in the drawings, the support surfaces 26 of the base 24 are constructed and arranged to align the adjacent channel sections 12 such that the trench defined thereby has a generally level or unsloped bottom surface. Alternatively, such as in drainage applications, the bottom walls 14 of the channel sections can be vertically sloped to facilitate run-off or fluid flow through the trench. In such an alternative construction, the support surfaces 26 that align the adjacent channel sections in a predetermined vertical relationship are preferably positioned to align the adjacent channel sections in the predetermined vertically sloping relationship.

While the support surfaces 26 of the base 24 of the illustrated embodiment are constructed so as to vertically align adjacent channel sections 12, the jaw members 32 may, instead, include a surface or other feature for vertically aligning adjacent channel sections, if so desired.

As best illustrated in FIG. 4, the bottom surface 24*a* of the base 24 includes a pair of bores 52 positioned therein such that the bores 52 are generally aligned in a vertical direction with respect to corresponding bores 52 in the support surfaces 26. The alignment of bores 52 can be generally perpendicular to the longitudinal and lateral axes defined by aligned channel sections. In embodiments of the present invention in which the bottom walls 14 of the channel sections 12 are vertically sloped, the bores defined by the jaw members are preferably positioned to be in general vertical upright alignment when the jaw members are oriented according to the vertically sloping relationship defined by the bottom walls of the channel sections.

Figure 8:
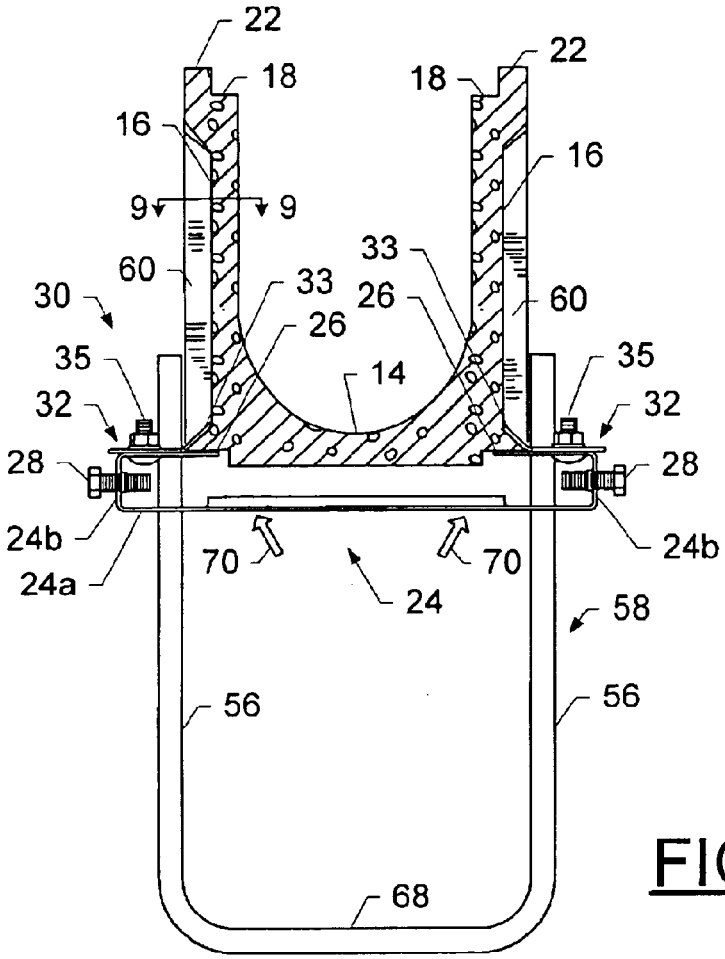
FIG. 8 is a transverse cross-sectional view of the channel system of FIG. 6, taken along line 8—8 of FIG. 6.

The alignment key 30 also preferably includes a plurality of vertical support members 56, such as rebar rods. Whereas the vertical support members in one advantageous embodiment comprise rebar rods, the vertical support members can be of any of a number of different designs without departing from the spirit and scope of the present invention. For example, the vertical support members can be made from other metallic or composite materials. Additionally, or alternatively, each vertical support member can include a substantially flat central wall and a pair of opposed side walls that extend therefrom. For a further description of such vertical support members, see U.S. Pat. No. 5,735,637, entitled: *Method and Apparatus for Supporting and Anchoring Drainage Channel Sections*, issued Apr. 7, 1998 to Gunter, the contents of which are hereby incorporated by reference in its entirety. As best illustrated in FIGS. 1, 2 and 8, the vertical support members can be integrally connected legs of a generally U-shaped anchoring member 58. Alternatively, the vertical support member can be a plurality of discrete rods which may have a foot or other laterally extending portion at a lower end thereof for setting upon or being suspended above a support surface. Alternatively, the vertical support member may be a linear member, lower portions of which may be driven into the earth. In either embodiment, the generally vertically aligned bores 52 of the horizontally extending portions 48 of each jaw member 32 are sized and aligned to receive a respective vertical support member.

The support members 56 are adapted to extend through respective bores 52. Then, when the support members 56 extend through the bores 52, one or both of the support members 56 are adapted for movement relative to the bores 52 so as to adjust the vertical position of the base upon the support members. The support members may then be locked in place with respect to the base 24. The support members and the base may be locked in position in various manners including, in one embodiment, by moving at least one of the support members by applying a laterally inwardly directed force to the respective support members, such as by the tightening of one of a pair of locking members. In the illustrated embodiment, for example, the locking members include threaded bolts 28 that are received by apertures defined in side portions 24*b* of the base that connect the bottom surface to respective support surfaces 26. As discussed below, moving the support members within the respective bores 52 into contact with the support surfaces and the bottom surface 24*a* of the base 24 effectively locks the support members in place with respect to the base.

When the bores 52 defined in the bottom surface 24*a* of the base 24 and in the support surfaces 26 are aligned with the support rod 56, the base is free to move vertically on the support member. The position of the base 24 with respect to the vertical support member 56 extending through the aligned bores 52 of the horizontally extending bottom surface 24*a* and the support surfaces 26 can then be fixed, such as described above. For example, once the position of the base 24 relative to the vertical support members 56, which extend through the vertically aligned bores of the horizontally extending portions of the base 24 (i.e., bottom surface 24*a* and support surfaces 26), is selected, a laterally inwardly directed force can be applied, such as through tightening of bolts 28 that extend through the side portions 24*b* of the base 24, to force the support members into contact with the support surfaces 26 and the bottom surface 24*a* of the base 24 at the respective bores. By forcing the support members 56 into contact with the base 24, the base is secured or fixed to the vertical support members. Accordingly, the relative spacing between the bottom wall 14 of the channel sections 12 and the bottom of the ditch, with which lower portions of the vertical support member may be engaged, can be controllably selected.

As best illustrated in FIGS. 1 and 8, the bottom surface 24*a* of the base 24 preferably extends beneath the channel sections 12 between lower portions of the opposed jaw members 32; generally in a substantially horizontal orientation. In addition, the bottom surface of the base is illustratively spaced a slight distance from the bottom wall 14 of the channel sections. In this regard, the base typically defines an opening 24*c*. By so defining the opening and including an upturned (or downturned) lip thereabout, the base advantageously has increased structural rigidity. Additionally, the opening facilitates hardenable composition contacting the bottom wall of the adjacent channel sections during installation of the channel sections, described below. Although shown and described as being spaced a slight distance from the bottom wall of the channel sections, the bottom surface can engage and even support the bottom wall of the channel sections according to other embodiments of the present invention.

Figure 7:
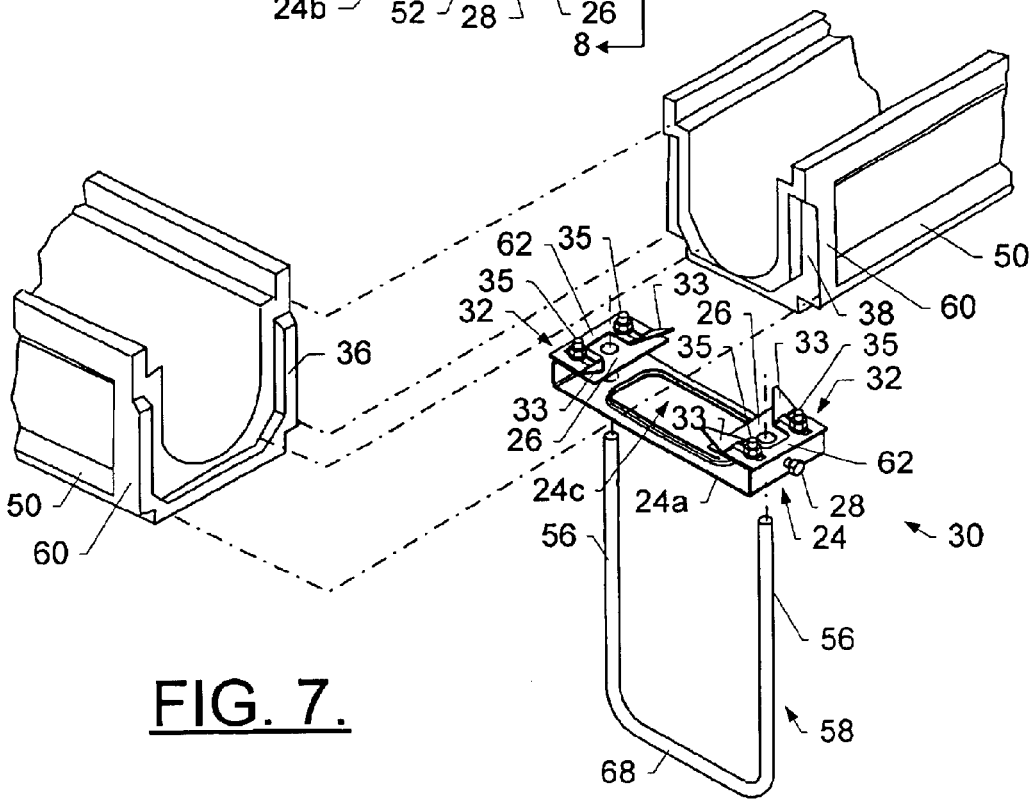
FIG. 7 is an exploded perspective view of one embodiment of an alignment key according to the present invention illustrating its relationship to the end portions of a pair of adjacent channel sections and wherein the end portion of one channel section is shown in a rearranged horizontally transverse orientation in order to better illustrate the end face thereof.

Although any of various channel constructions can be used in the present invention, as illustrated in FIG. 7, the alignment and interlocking of adjacent channel sections can be facilitated by channel sections having corresponding male and female portions 36 and 38, respectively, defined by end portions of the adjacent channel sections 12. More particularly, the end portion of a first channel section can include a male lip or tongue portion 36 adapted to fit into a corresponding female recess or groove portion 38 defined by an end portion of a second adjacent channel section. As shown in FIG. 7, in one preferred channel construction the male portion defined at an end portion of a first channel section includes a lip forming portions of the bottom wall and both sidewalls of the channel section which extends longitudinally outward from the end surface of the channel section. Correspondingly, the female portion defined at an end portion of a second channel section includes a recessed portion in the sidewalls and bottom wall of the channel section which is adapted to receive the longitudinally extending projections of the first channel section. In addition, a sealant or other type of adhesive can be disposed between the end portions of the adjacent channel sections to further seal the adjacent channel sections.

In the embodiment of the invention shown in the drawings, each channel section 12 preferably has an outwardly extending vertical lip 60 of a predetermined lateral width proximate the opposed ends of the channel section. Each jaw member 32 includes a recessed central portion 62 defined between the longitudinally opposed surfaces 34*a* and 34*b*. As illustrated in FIGS. 6 and 7, the recessed central portion has a predetermined longitudinal width adapted to receive the lips 60 of the adjacent channel sections.

As indicated above, each jaw member 32 is adapted to be removably secured to a respective support surface 26 of the base 24. Therefore, the jaw members can be positioned laterally and/or longitudinally relative to respective support surfaces and, as such, relative to the adjacent channel sections 12. In this regard, the jaw members may be positioned with respect to the end portions of the channel sections, and thereafter locked into place to secure the alignment key 30 to the channel sections, and to interlock adjacent channel sections together. Whereas the jaw members can be aligned relative to the channel sections in any of a number of different manners, in one embodiment the jaw members are positioned by being longitudinally aligned with the outwardly extending vertical lip 60 of the respective channel sections. Laterally, then, the jaw members are positioned by drawing the jaw members inward toward the longitudinal axis 44 defined by the aligned channel sections, and into contact with the channel sections, such as by applying an inwardly directed force to the jaw members.

Figure 9:
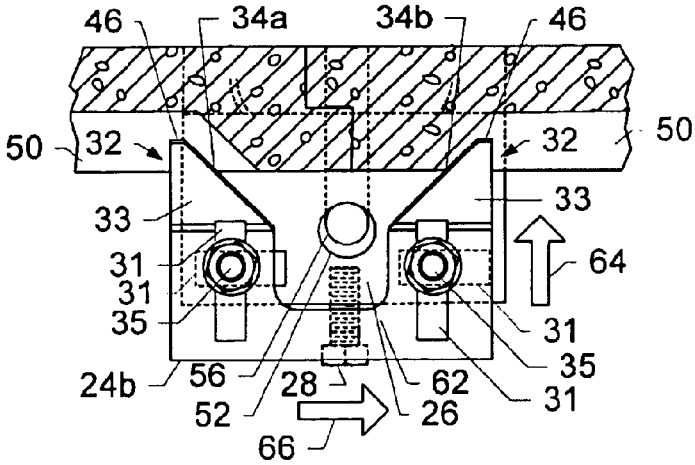
FIG. 9 is an exaggerated fragmentary top cross-sectional view taken along line 9—9 of FIG. 8 to illustrate movement of one of the jaw members laterally and longitudinally relative to a respective support surface of the base, according to one embodiment of the present invention.

Although the jaw members 32 can be positioned in any of a number of different manners laterally and/or longitudinally with respect to the support surfaces, when a jaw member 32 is disposed as illustrated in FIG. 9, the respective jaw member can be positioned by moving the jaw member laterally, as indicated by arrow 64, as well as longitudinally, as indicated by arrow 66. Advantageously, applying a laterally inwardly directed force to the opposed jaw members 32 to position the jaw members urges the adjacent channel sections 12 into a longitudinally interlocked and aligned relationship. In this regard, the laterally inwardly directed force facilitates the longitudinally interlocking and aligning of the adjacent channel sections due to the camming action of the complimentarily shaped longitudinally opposed surfaces 34*a* and 34*b* of the opposed jaw members on the exterior surfaces of predetermined shape of the opposed sidewalls 16 of the adjacent channel sections. In particular, as the opposed jaw members are drawn laterally inward, the adjacent channel sections are forced together.

Irrespective of how the jaw members are positioned relative to the support surfaces or the channel sections, after the jaw members are positioned, the jaw members may be locked into position. For example, the jaw members may be locked into position by tightening bolts 35 that extend through the slots 31 defined by the jaw members and corresponding slots 31 defined by the support surfaces 26. The aligned and interlocked channel sections 12 can then be anchored within the ditch 64 or otherwise upon a support surface. In particular, vertical support members 56 preferably extend through the aligned bores 52 defined in the horizontally extending support members 26 and the bottom surface 24*a* of the base, as described hereinabove.

In embodiments in which the vertical support members 56 engage the bottom of the ditch 64 or other support surface as shown in FIG. 2, the position of the channel sections 12 relative to the bottom of the ditch or other support surface can be selectably controlled by positioning the base 24, and therefore the jaw members 32 carried by the support surfaces 26, on the respective vertical support members. Alternatively, once the base has engaged the vertical support members, the channel sections, along with the alignment key 30 may be suspended within a ditch or the like. Once the channel sections are positioned relative to the bottom of the ditch or other support surface, a subslab 67 can then be formed around lower portions of the vertically extending members at a location spaced below the bottom walls 14 of the channel sections to anchor the vertical support members and, in turn, the channel sections in the ditch.

For example, in the illustrated embodiment of the present invention in which the vertical support members 56 are legs of a generally U-shaped member 58, the generally U-shaped member also includes a central portion 68 extending between the vertical support members. The central portion of the U-shaped member can then rest on or be suspended above the bottom of the ditch 64 such that the generally U-shaped member can be anchored within the ditch by forming a subslab 67 around the central portion of the U-shaped member at a location spaced below the bottom walls 14 of the channel sections 12.

Once the subslab 67 has cured or set, hardenable composition 69 can be poured around the anchored channel sections 12 to form a completed channel as the moldable composition sets. Advantageously, as the hardenable composition is poured around the channel sections, the bottom surface of the clamping members 33 of the jaw members 32 act to counter the flotation forces of the channel sections 12, and the tipping forces on the channel sections. A grate 20 can then be placed across the open top of the trench as shown in FIG. 2. Preferably, the upper surface of the hardenable composition is substantially coplanar with the upper portions of the sidewalls 16 of the channel sections and the grate to form a level surface. Also, preferably the hardenable composition passes through the opening 24*c* defined in the bottom surface 24*a* of the base to thereby contact the bottom wall 14 of the channel sections, as shown by arrows 70 in FIG. 8. Therefore, a drainage trench defined by a plurality of channel sections which are longitudinally interlocked and which are both vertically and laterally aligned can be readily formed according to the method and apparatus of the present invention.

Although an alignment key 30 having a particular shape and configuration is illustrated and described hereinabove, alignment keys having other shapes which align and longitudinally interlock adjacent channel sections 12 can also be employed without departing from the spirit and scope of the present invention. For example, the support surfaces 26 and the opposed clamping surfaces 34*a* and 34*b* can extend inwardly the same or different distances without departing from the spirit and scope of the present invention.

In addition, the opposed clamping surfaces 34*a* and 34*b* may or may not be shaped to match the upper beveled surface of the longitudinal lip 50 of a channel section 12. In this regard, the shape and angle of the opposed clamping surfaces need not match the upper beveled surface of the longitudinal lip, but can, instead, be formed in other shapes while still engaging exterior portions of the sidewalls 16 of the channel sections. Such variations in shape and angle may be particularly desirable in instances in which the increases in the flexibility or modulus of the opposed clamping surfaces are advantageous.

Still further, although the support surfaces 26 are described and shown as extending horizontally inward, the support surfaces can extend at other angles without departing from the spirit and scope of the present invention. For example, the support surfaces can extend generally vertically upward and horizontally inward to contact the lower surface of the longitudinal lip 50 of a channel section 12. As described above, such variations in shape and angle of the horizontal tab may be particularly desirable in instances in which the increases in the flexibility or modulus of the tab are advantageous.

According to the present invention, a plurality of channel sections 12 are aligned and longitudinally interlocked within a preformed ditch 64 or upon some other support surface. The plurality of channel sections are aligned, according to the invention, with an alignment key 30 longitudinally bridging between each adjacent pair of channel sections. As described above, the alignment key longitudinally interlocks the adjacent channel sections by applying a longitudinally compressive force. The adjacent channel sections are also preferably aligned by the alignment key and, more preferably, are both laterally and vertically aligned by engagement of predetermined exterior portions of the respective sidewalls 16 of the adjacent channel sections with the lateral alignment surface 46 and the vertical alignment surface 48, respectively, of the jaw member 32.

The opposed jaw members 32 are urged into engagement with the respective sidewalls 16 of the adjacent channel sections 12 by laterally inwardly directed force to thereby laterally position the jaw members 32. By urging the opposed jaw members into engagement with the respective sidewalls of the adjacent channel sections, the adjacent channel sections are aligned and longitudinally interlocked. Advantageously, the jaw members can additionally or alternatively be positioned longitudinally with respect to the support surfaces 26 of the base 24, and therefore the adjacent channel sections.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An alignment key for aligning and interlocking adjacent channel sections, each longitudinally extending channel section having a predetermined exterior shape defined by a bottom wall and first and second sidewalls extending upwardly from opposite sides of the bottom wall, the alignment key comprising:

a base shaped for laterally bridging across a predetermined exterior portion of adjacent bottom walls of the adjacent channel sections; and first and second opposed, inwardly facing jaw members shaped for longitudinally bridging across a predetermined exterior portion of adjacent first, and adjacent second sidewalls, respectively, of the adjacent channel sections;

each of the jaw members capable of being carried by the base and capable of being positioned in a lateral and a longitudinal direction with respect to the base to thereby substantially align and interlock the channel sections.

2. An alignment key according to claim 1, wherein each jaw member includes a surface positioned to engage the predetermined exterior portions of the respective sidewalls to laterally align the adjacent channel sections.

3. An alignment key according to claim 1, wherein each jaw member includes a surface positioned to engage the predetermined exterior portions of the respective sidewalls to align the adjacent channel sections in a predetermined vertical relationship.

4. An alignment key according to claim 1, wherein the base comprises a pair of support surfaces capable of carrying respective jaw members, and wherein each of the jaw members capable of being positioned in a lateral and a longitudinal direction with respect to a respective support surface.

5. An alignment key according to claim 4, wherein each support surface includes at least one slot extending laterally, wherein each jaw member includes at least one slot extending perpendicular relative to the at least one slot of a respective support surface when the jaw members are carried by the respective support surfaces, and wherein the alignment key further comprises securing members that extend through the respective slots defined by the jaws and the support surfaces.

6. An alignment key according to claim 5, wherein the securing members are capable of being moved within the slots defined by the support surfaces to thereby longitudinally position the jaw members relative to respective support surfaces, and wherein the jaw members are capable of being moved such that the position of the securing members within slots defined by the jaw members changes to thereby laterally position the jaw members relative to respective support surfaces.

7. An alignment key according to claim 4, wherein the base further comprises a bottom surface disposed in a spaced apart relationship with respect to the support surfaces of the base, wherein each support surface includes a bore, and wherein the bottom surface includes a pair of bores, each bore of the bottom surface being generally aligned relative to a bore of a respective support surface.

8. An alignment key according to claim 7 further comprising a plurality of support members, wherein the aligned bores are adapted for receiving the support members.

9. An alignment key according to claim 8, wherein the support members are legs of a generally U-shaped member.

10. An alignment key according to claim 1, wherein each of the jaw members includes longitudinally opposed surfaces positioned to engage the predetermined exterior portions of the respective sidewalls.

11. An alignment key according to claim 10, wherein each of the channel sections extends between opposite ends and has an outwardly extending lip of a predetermined width proximate the opposed ends thereof, and wherein each jaw member includes a recessed central portion defined between the opposed longitudinal surfaces, the recessed central portion having a predetermined longitudinal width adapted to receive the lips of the adjacent channel sections.

12. An alignment key according to claim 10, wherein the corresponding longitudinally opposed surfaces of the jaw members are inwardly converging in a direction extending outwardly from a longitudinal axis of each channel section.

13. An alignment key according to claim 12, wherein the corresponding longitudinally opposed surfaces of the jaw members are inwardly converging in generally opposed longitudinal directions.

14. An alignment key according to claim 1, wherein the jaw members comprise corresponding vertically extending surfaces positioned to engage predetermined exterior portions of the respective sidewalls, and wherein the vertically extending surfaces are inwardly converging along a generally vertical direction.

15. An alignment key according to claim 1, wherein the base comprises:

a pair of support surfaces capable of carrying respective jaw members; and a bottom surface disposed in a spaced apart relationship with respect to the support surfaces of the base, wherein the bottom surface defines an opening therethrough.

16. A channel system comprising:

a plurality of longitudinally extending channel sections, each channel section having a predetermined exterior shape defined by a bottom wall and first and second sidewalls extending upwardly from opposite sides of the bottom wall; and an alignment key for aligning and interlocking adjacent channel sections, the alignment key comprising a base capable of laterally bridging across a predetermined exterior portion of adjacent bottom walls of the adjacent channel sections, and wherein the alignment key further comprises first and second opposed, inwardly facing jaw members shaped for longitudinally bridging across a predetermined exterior portion of the adjacent first, and adjacent second sidewalls, respectively, of the adjacent channel sections, each of the jaw members capable of being carried by the base and capable of being positioned in a lateral and a longitudinal direction with respect to the base to thereby substantially align and interlock the channel sections.

17. A channel system according to claim 16, wherein each of the jaw members includes a pair of longitudinally opposed clamping members shaped to engage the exterior portion of the respective sidewalls.

18. A channel system according to claim 17, wherein the exterior portion of predetermined shape of the first and second sidewalls includes an exterior angled surface oriented in both a longitudinal and an outward direction, and wherein the corresponding longitudinally opposed clamping members of the jaw members are inwardly converging with respect to a longitudinal axis of each channel to engage the exterior angled surface.

19. A channel system according to claim 18, wherein the jaw members comprise corresponding vertically extending surfaces positioned to engage the exterior angled surface of the respective sidewalls, and wherein the vertically extending surfaces are inwardly converging along a generally vertical direction.

20. A channel system according to claim 16, wherein the base of the alignment key further comprises a pair of support surfaces capable of carrying respective jaw members, and capable of engaging and aligning the bottom walls of each of the adjacent channel sections, and wherein each of the jaw members is capable of being positioned in a lateral and a longitudinal direction with respect to a respective support surface.

21. A channel system according to claim 20, wherein each support surface of the alignment key includes at least one slot extending laterally, wherein each jaw member of the alignment key includes at least one slot extending perpendicular relative to the at least one slot of a respective support surface when the jaw members are carried by the respective support surfaces, and wherein the alignment key further comprises securing members that extend through the respective slots defined by the jaws and the support surfaces.

22. A channel system according to claim 21, wherein the securing members are capable of being moved within the slots defined by the support surfaces to thereby longitudinally position the jaw members relative to respective support surfaces, and wherein the jaw members are capable of being moved such that the position of the securing members within slots defined by the jaw members changes to thereby laterally position the jaw members relative to respective support surfaces.

23. A channel system according to claim 20, wherein each jaw member also includes a surface to laterally align the adjacent channel sections.

24. A channel system according to claim 20, wherein the base of the alignment key further comprises a bottom surface disposed in a spaced apart relationship with respect to the support surfaces of the base, wherein each support surface includes a bore, and wherein the bottom surface includes a pair of bores, each bore of the bottom surface being generally aligned relative to a bore of a respective support surface.

25. A channel system according to claim 24, wherein the alignment key further comprises a plurality of support members, and wherein the aligned bores are adapted for receiving the support members.

26. A channel system according to claim 25, wherein the support members are legs of a generally U-shaped member.

27. A channel system according to claim 16, wherein each of the jaw members includes longitudinally opposed surfaces positioned to engage the predetermined exterior portions of the respective sidewalls.

28. A channel system according to claim 27, wherein each of the channel sections extend between opposite ends and has an outwardly extending lip of a predetermined width proximate the opposed ends thereof, and wherein each jaw member includes a recessed central portion defined between the opposed longitudinal surfaces, the recessed central portion having a predetermined longitudinal width adapted to receive the lips of the adjacent channel sections.

29. A channel system according to claim 27, wherein the corresponding longitudinally opposed surfaces of the jaw members are inwardly converging in generally opposed longitudinal directions.

30. A channel system according to claim 16, wherein the base of the alignment key comprises:

a pair of support surfaces capable of carrying respective jaw members; and a bottom surface disposed in a spaced apart relationship with respect to the support surfaces of the base, wherein the bottom surface defines an opening therethrough.

31. An alignment key comprising:

a base having opposed support surfaces; and first and second opposed inwardly facing jaw members mounted upon respective support surfaces, wherein the first and second jaw members are independently movable relative to the respective support surfaces, and wherein each of the jaw members is capable of being positioned in at least one of a lateral and a longitudinal direction with respect to a respective support surface.

32. An alignment key according to claim 31, wherein each jaw member includes a surface positioned to engage predetermined exterior portions of respective sidewalls of adjacent channel sections to laterally align the adjacent channel sections.

33. An alignment key according to claim 31, wherein each jaw member includes a surface positioned to engage predetermined exterior portions of respective sidewalls of adjacent channel sections to align the adjacent channel sections in a predetermined vertical relationship.

34. An alignment key according to claim 31, wherein each of the jaw members capable of being positioned in a lateral and a longitudinal direction with respect to a respective support surface.

35. An alignment key according to claim 31, wherein each of the jaw members includes longitudinally opposed surfaces positioned to engage predetermined exterior portions of respective sidewalls of adjacent channel sections.

36. An alignment key according to claim 31, wherein the bottom surface is disposed in a spaced apart relationship with respect to the support surfaces, and wherein the bottom surface defines an opening therethrough.

37. An alignment key comprising:

a base having opposed support surfaces, wherein each support surface includes at least one slot extending laterally;

first and second opposed inwardly facing jaw members mounted upon respective support surfaces, wherein the first and second jaw members are independently movable relative to the respective support surfaces, wherein each of the jaw members capable of being positioned in a lateral and a longitudinal direction with respect to a respective support surface, wherein each jaw member includes at least one slot extending perpendicular relative to the at least one slot of a respective support surface when the jaw members are carried by the respective support surfaces; and securing members that extend through the respective slots defined by the jaws and the support surfaces.

38. An alignment key according to claim 37, wherein the securing members are capable of being moved within the slots defined by the support surfaces to thereby longitudinally position the jaw members relative to respective support surfaces, and wherein the jaw members are capable of being moved such that the position of the securing members within slots defined by the jaw members changes to thereby laterally position the jaw members relative to respective support surfaces.

39. An alignment key comprising:

a base having opposed support surfaces and, a bottom surface disposed in a spaced apart relationship with respect to the support surfaces, wherein each support surface includes a bore, and wherein the bottom surface includes a pair of bores, each bore of the bottom surface being generally aligned relative to a bore of a respective support surface; and first and second opposed inwardly facing jaw members mounted upon respective support surfaces, wherein the first and second jaw members are independently movable relative to the respective support surfaces.

40. An alignment key according to claim 39 further comprising a plurality of support members, wherein the aligned bores are adapted for receiving the support members.

41. An alignment key according to claim 40, wherein the support members are legs of a generally U-shaped member.

42. An alignment key comprising:

a base having opposed support surfaces; and first and second opposed inwardly facing jaw members mounted upon respective support surfaces, wherein the first and second jaw members are independently movable relative to the respective support surfaces, wherein each of the jaw members includes longitudally opposed surfaces positioned to engage predetermined exterior portions of respective sidewalls of adjacent channel sections, and wherein each of the channel sections extends between opposite ends and has an outwardly extending lip of a predetermined width proximate the opposed ends thereof, and wherein each jaw member includes a recessed central portion defined between the opposed longitudinal surfaces, the recessed central portion having a predetermined longitudinal width adapted to receive the lips of the adjacent channel sections.

43. An alignment key comprising:

a base having opposed support surfaces; and first and second opposed inwardly facing jaw members mounted upon respective support surfaces, wherein the first and second jaw members are independently movable relative to the respective support surfaces, wherein each of the jaw members includes longitudally opposed surfaces positioned to engage predetermined exterior portions of respective sidewalls of adjacent channel sections, and wherein the corresponding longitudinally opposed surfaces of the jaw members are inwardly converging in a direction extending outwardly from a longitudinal axis of each channel section.

44. An alignment key according to claim 43, wherein the corresponding longitudinally opposed surfaces of the jaw members are inwardly converging in generally opposed longitudinal directions.

45. An alignment key comprising:

a base having opposed support surfaces; and first and second opposed inwardly facing jaw members mounted upon respective support surfaces, wherein the first and second jaw members are independently movable relative to the respective support surfaces wherein the jaw members comprise corresponding vertically extending surfaces positioned to engage predetermined exterior portions of respective sidewalls of adjacent channel sections, and wherein the vertically extending surfaces are inwardly converging along a generally vertical direction.

46. A method of forming a channel comprised of a plurality of longitudinally extending channel sections, each channel section having a predetermined exterior shape defined by a bottom wall and first and second sidewalls extending upwardly from opposite sides of the bottom wall, the method comprising the steps of:

aligning the plurality of channel sections with at least one alignment key, wherein each alignment key includes a base for laterally bridging across a predetermined exterior portion of adjacent bottom walls of the adjacent channel sections, wherein the alignment key further includes first and second opposed, inwardly facing jaw members shaped for longitudinally bridging across a predetermined exterior portion of the adjacent first, and adjacent second sidewalls, respectively, of the adjacent channel sections, each of the jaw members carried by the base, and wherein aligning the channel sections includes positioning the jaw members in a lateral and a longitudinal direction with respect to the base;

anchoring the aligned channel sections relative to a support surface; and pouring a moldable composition around the anchored channel sections to form a completed channel as the moldable composition sets.

47. A method according to claim 46, wherein each jaw member includes a lateral alignment surface, and wherein the aligning step comprises a step of laterally aligning the adjacent channel sections by engaging predetermined exterior portions of the respective sidewalls with the lateral alignment surface of each jaw member.

48. A method according to claim 46, wherein each jaw member includes a vertical alignment surface, and wherein the aligning step comprises a step of vertically aligning the adjacent channel sections by engaging predetermined exterior portions of the respective sidewalls with the vertical alignment surface of each jaw member.

49. A method according to claim 46, wherein the aligning step comprises positioning the opposed jaw members in a lateral and a longitudinal direction such that the jaw members engage the first and second sidewalls, respectively.

50. A method according to claim 46, wherein the base of the alignment key includes a pair of support surfaces capable of carrying respective jaw members, and wherein the aligning step comprises positioning the jaw members in a lateral and a longitudinal direction with respect to respective support surfaces.

51. A method according to claim 50, wherein each support surface includes a at least one slot extending laterally, wherein each jaw member includes at least one slot extending perpendicular relative to the at least one slot of a respective support surface when the jaw members are carried by the respective support surfaces, wherein the alignment key further includes securing members that extend through the respective slots defined by the jaws and the support surfaces, and wherein the aligning step comprises aligning the jaw members and thereafter locking the jaw members in place with respective securing members.

52. A method according to claim 51, wherein the aligning step comprises at least one of moving the securing members within the slots defined by the support surfaces to thereby longitudinally position the jaw members relative to respective support surfaces, and moving the jaw members such that the position of the securing members within slots defined by the jaw members changes to thereby laterally position the jaw members relative to respective support surfaces.

53. A method according to claim 46, wherein the alignment key further comprises a plurality of support members adapted to be movably secured to the base of the alignment key, and wherein the aligning step further includes vertically positioning the support members relative to the base and thereafter securing the support members to the base.

54. A method according to claim 53 further comprising the steps of positioning second ends of the support members, opposite the first end, relative to the support surface and forming a subslab around the second ends of the support members at a location spaced below the bottom surface of the channel sections.

55. A method according to claim 46, wherein each jaw member includes longitudinally opposed surfaces, and wherein positioning the jaw members includes positioning the jaw members to engage the predetermined exterior portions of the respective sidewalls of the adjacent channel sections.

56. A method according to claim 55, wherein each of the channel sections have an outwardly extending lip of a predetermined width proximate the opposed ends thereof, and wherein each jaw member includes a recessed central portion defined between the longitudinally opposed surfaces, the recessed central portion having a predetermined longitudinal width adapted to receive the lips of the adjacent channel sections, and wherein the aligning step further comprises a step of positioning the outwardly extending lips of adjacent channel sections in the recessed central portion.

57. A method according to claim 46, wherein the base of the alignment key comprises a pair of support surfaces capable of carrying respective jaw members, and a bottom surface disposed in a spaced apart relationship with respect to the support surfaces of the base, wherein the bottom surface defines an opening therethrough, and wherein the pouring step comprises pouring the moldable composition such that at least a portion of the moldable composition fills the opening defined by the bottom surface and contacts bottom walls of the channel sections.

* * * * *